US005404946A

United States Patent [19]

Hess

[11] Patent Number: 5,404,946

[45] Date of Patent: Apr. 11, 1995

[54] WIRELINE-POWERED INFLATABLE-PACKER SYSTEM FOR DEEP WELLS

[75] Inventor: Alfred E. Hess, Boulder, Colo.

[73] Assignee: The United States of America as represented by the Secretary of the Interior, Washington, D.C.

[21] Appl. No.: 100,808

[22] Filed: Aug. 2, 1993

[51] Int. Cl.[6] ..... E21B 23/06; E21B 33/127

[52] U.S. Cl. ..... 166/187; 166/325

[58] Field of Search ..... 166/187, 66.4, 179, 166/385, 319, 325

[56] References Cited

U.S. PATENT DOCUMENTS

| | | | |
|---|---|---|---|
| 2,511,759 | 6/1950 | Williams | 166/187 X |
| 2,629,446 | 2/1953 | Freling et al. | 166/187 |
| 2,675,080 | 4/1954 | Williams | 166/187 |
| 2,681,706 | 6/1954 | Dottorf | 166/187 |
| 2,872,230 | 2/1959 | Desbrandes | 166/187 X |
| 3,066,739 | 12/1962 | Saurenman et al. | 166/187 X |
| 3,538,330 | 11/1970 | Youmans | 166/187 X |
| 4,800,752 | 1/1989 | Piers | 73/155 |
| 4,892,144 | 1/1990 | Coone | 166/106 |
| 5,027,894 | 7/1991 | Coone et al. | 166/122 |
| 5,094,294 | 3/1992 | Bayh, III | 166/122 |

*Primary Examiner*—David J. Bagnell
*Attorney, Agent, or Firm*—E. Philip Koltos

[57] ABSTRACT

A borehole probe containing one or more inflatable packers, usually, although not necessarily, in connection with geophysical sensors, is hung from a geophysical logging cable. The packers are inflated or deflated with liquid at ambient borehole pressure, advantageously, the liquid resident in the borehole, using a submersible, reversible electric pump which is part of the borehole packer assembly. The electric pump is powered and controlled from the surface through the interconnecting logging cable. A differential pressure actuated valve located between the pump and packer controls the flow of pumped fluid into and out of the packers. The packers may be used to control the movement of borehole fluid at any desired depth within a borehole, constrained only by the length of the interconnecting logging cable.

20 Claims, 6 Drawing Sheets

WIRELINE-POWERED INFLATABLE-PACKER SYSTEM FOR DEEP WELLS

ORIGIN OF THE INVENTION

The invention described herein was made by an employee of the United States Government and may be manufactured and used by or for the Government for Government purposes without payment of royalties thereon or therefor.

FIELD OF THE INVENTION

This invention relates to an inflatable packer or tool system having one or more inflatable packers or tools for use, in particular, in deep boreholes.

BACKGROUND OF THE INVENTION

Flow concentrators made of various hard and/or soft flexible materials have been fastened around the outside of the borehole flowmeters to increase sensitivity to slow flow, especially in larger diameter holes. Various other types of spring loaded expanding funnels have been used which fill the annulus between a flowmeter and the borehole wall. Such a funnel is disclosed in U.S. Pat. No. 4,800,752 to Piers. However, such devices may not adequately seal the hole, especially in holes having large diameter variations or irregularities, since these devices permit an unknown portion of the fluid to bypass the flowmeter. Additionally, there is no disclosure in the Piers patent as to how to adequately fill the tubular ring without over pressuring and bursting the ring, or under pressuring and having inadequate sealing. Further, problems may arise when such devices are used in deep boreholes having high pressures because there is no pressure equalization either between the reservoir liquid and the well fluid or for the electric pump motor. Also, the device disclosed in the Piers patent offers limited adjustability of packer diameter.

Borehole, wall conforming, inflatable packers, which are inflated with fluid pressure from the surface, are commonly used. This type of packer requires one or more pipes, conduits or tubes leading to the surface, and very careful pressure control to assure adequate inflation without over-pressure which would burst the bladder or under-pressure which would not give adequate sealing. This becomes very difficult to accomplish at great depths below the fluid surface or where the borehole fluid level is unknown or is subject to large changes. These conventional surface inflated fluid packer systems are usually heavy and require a drill rig or work-over rig to position or move the packers, especially in deep holes. U.S. Pat. No. 5,094,294 to Bayh, III is an example of a production well pump and packer assembly which is hydraulically set and released from the surface.

U.S. Pat. No. 4,892,144 to Coone and U.S. Pat. No. 5,027,894 to Coone et al. address some of the above-mentioned problems by providing an inflatable wall conforming packer which is reinforced by thin, elongate strips surrounding the packer. These strips are further used to grip the well bore as the packer is expanded in order to maintain the packer in its vertical position. However, these packers are heavy and still must be inflated by fluid pressure supplied from the surface through connecting conduits, pipes or tubing.

SUMMARY OF THE INVENTION

It is an object of the present invention to provide a wire-line supported and powered inflatable packer system that is relatively light in weight, and simple to set up and operate. The system of the present invention may be supported and operated using standard geophysical logging cable from portable logging systems, or using any other suitable electric cable.

It is a further object of the present invention to provide a packer system that can be used to seal the annulus around a flowmeter, even in rough and irregular boreholes or those having large diameter variations, thereby assuring accurate fluid flow measurements even at very slow flow rates.

It is a further object of the present invention to provide borehole inflatable packers that may be easily and quickly installed and positioned to any depth within a borehole while pumping liquid from or injecting liquid into the hole, which, when used with a borehole flowmeter, allows for the rapid determination of the relative hydraulic conductivity of the region of the earth penetrated by the borehole.

It is a further object of the present invention to provide an electric powered packer system which will operate reliably at depths in excess of 5000 meters and under pressures in excess of 500 bars.

It is a further object of the present invention to provide pressure equalization between the electric motor reservoir liquid and the well fluid.

The packer system of the present invention includes at least one wall conforming inflatable packer, means for pumping resident borehole fluid into and out of the inflatable packer for inflating and deflating the inflatable packer in its entirety, and inflation/deflation valve means, disposed between the inflatable packer and the pumping means, for controlling the fluid flow into and out of the inflatable packer, the valve means including means for preventing fluid from flowing out of the inflatable packer when the pumping means is stopped.

The packer system of the present invention is of a modular design thereby making it simple to reconfigure by adding packers or changing packer sizes to suit a particular situation.

Combining a wire-line powered packer with other geophysical borehole logging probes simplifies the equipment, decreases the amount of time needed to make measurements using packers, reduces the setup time, and minimizes the expense of equipment and personnel required by eliminating the requirement for a large drill rig or workover-rig.

The wireline packer of the present invention may be used to any depth that an electric logging cable can reach, which is far deeper than is practical for packers which are hydraulically inflated from the surface.

A borehole probe containing one or more inflatable packers according to the invention is preferably hung from a geophysical logging line or cable, usually, although not necessarily, in conjunction with a hydrologic sensor or sensors. The packers of the present invention are inflated or deflated with liquid from the borehole by a submersible electric pump which is part of the deep borehole packer assembly. Power from an electrical power source on the surface is transmitted through the conductors of the logging cable to the bi-directional packer pump. The packers may be used to control the movement of the borehole fluid at any desired depth in a borehole.

Other objects, features and advantages of the invention will be set forth in or will be apparent from the following description of the preferred embodiments of the invention.

DETAILED DESCRIPTION OF THE INVENTION

Figure 1A:
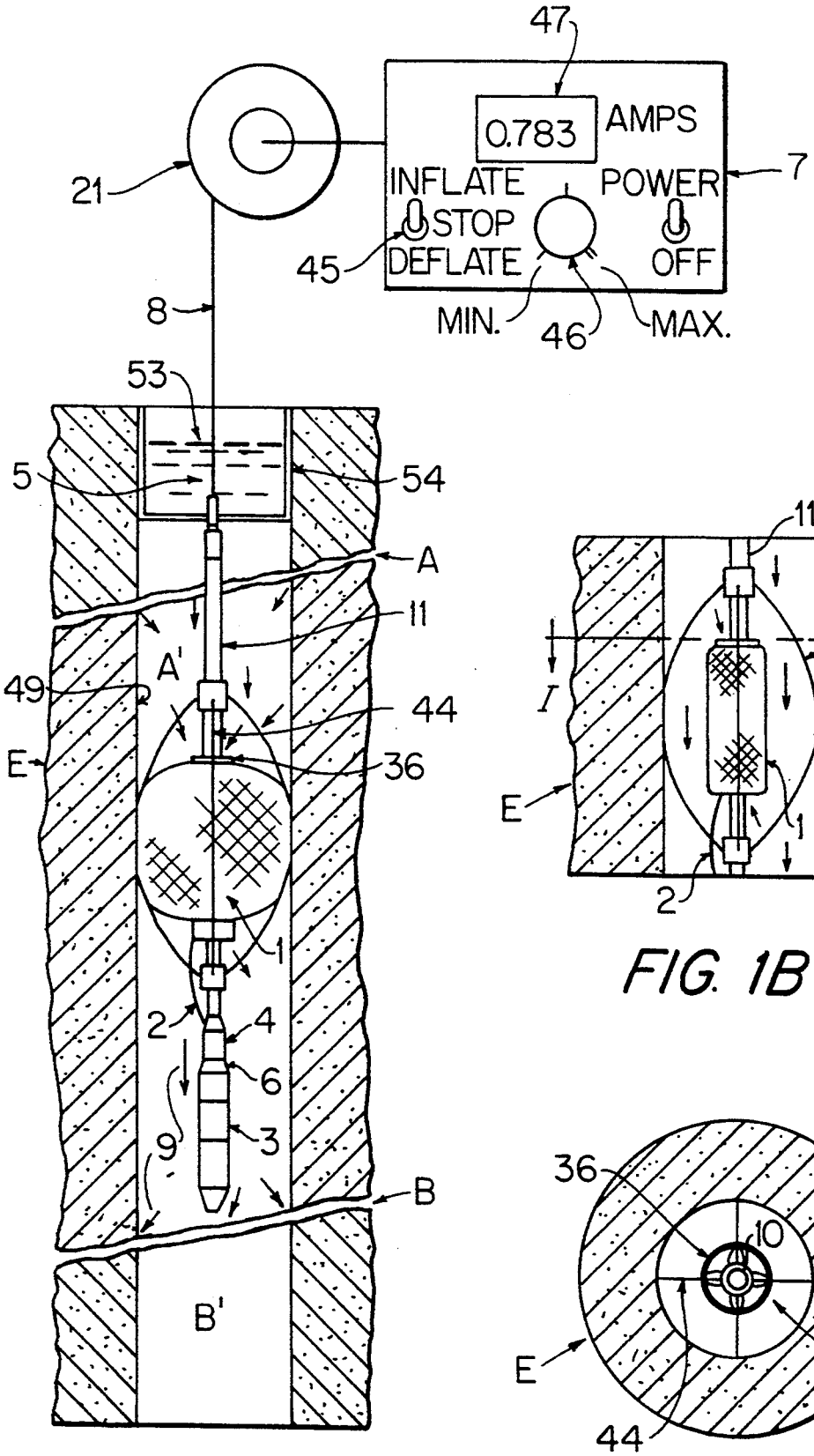
FIG. 1A is a longitudinal view of an inflated borehole paper system of an embodiment of the present invention.
Figure 1B:
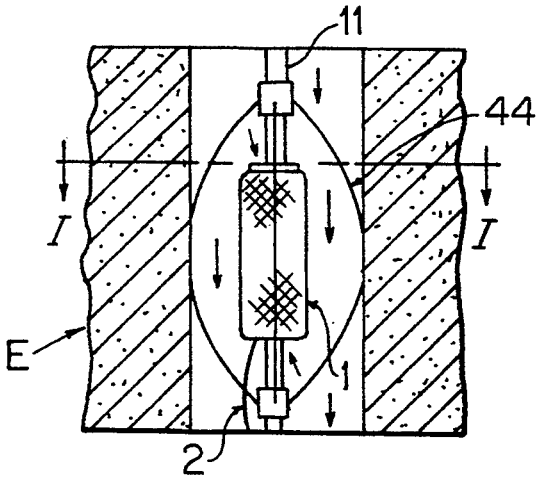
FIG. 1B is a side view of the deflated borehole packer.
Figure 1C:
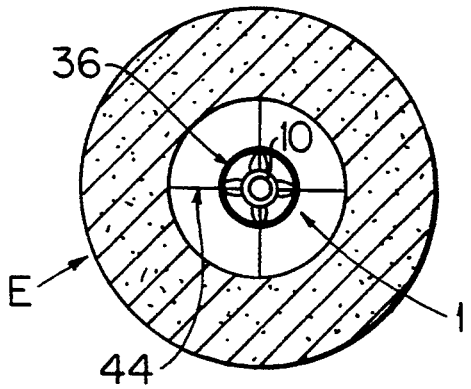
FIG. 1C is a cross sectional view of the deflated borehole of packer of FIG. 1B taken generally along line I—I.

One preferred embodiment of the packer system of the present invention includes, as shown in FIGS. 1A to 1C, a reinforced, wall-conforming inflatable packer 1 located within a borehole 49 in the earth E containing a borehole casing 54. Packer 1 is, as illustrated, connected by tubing 2 to a valve chamber 4 which is shown in more detail in FIG. 3. Valve chamber 4 controls the flow of the borehole liquid, indicated at 5, from a pump system 3 that provides the pressure to inflate the packer 1. Pump system 3, and valve chamber 4 are suspended beneath packer 1. A filter 6 disposed between valve chamber 4 and pump system 3 removes potentially damaging debris from the borehole liquid 5 before the borehole liquid 5 enters the packer pump system 3.

A conventional winch, 21 located at the surface, controls the movement of the packer system within the borehole and is connected through a logging cable 8 to an electronic unit 11 which contains the probe electronics and is disposed above packer 1. Packer pump system 3, which is described in more detail below in connection with FIG. 3, receives electrical power from a packer pump control panel 7 located on the surface through the logging cable 8.

When, as indicated in FIG. 1A, inflated packer 1 concentrates the flowing borehole fluid, indicated by arrows at 9, i.e., the fluid flowing within borehole in the vicinity of packer 1 through a flowmeter 10 which is disposed within the hollow packer mandrel 36 in the center of the packer 1, as seen most clearly in FIG. 1C. This greatly increases both the sensitivity and accuracy of flowmeter 10 to the borehole flow 9 between two or more fractures or aquifers, (illustrated in FIG. 1A by a flow 9 between an upper fracture A and a lower fracture B), and also reduces flow measurement error due to thermally driven convection currents which frequently exists within the fluid of boreholes. Such convection currents are caused by the normal temperature gradient which exists in the earth.

When deflated, as shown in FIG. 1B, packer 1 can be moved to any depth location in a borehole, within the limits of length of the logging cable 8, for subsequent inflation and geophysical measurements. A hydraulic zone includes the entire liquid volume that is in unrestricted hydraulic communication with the liquid in a given fracture. In FIG. 1A, hydraulic zone A′ extends up from packer 1 to water level 53 and includes fracture A. Hydraulic zone B′ extends down from packer 1 to the bottom of the borehole and includes fracture B.

One or more sets of non-jamming bow-spring centralizers 44, shown in FIGS. 1A and 1B (and disclosed in detail in U.S. Pat. No. 5,226,333, hereby incorporated by reference) are mounted around or adjacent to the packer 1 to keep the packer from being abraded by the walls 49 of the borehole when the packer 1 is moved to various depths in the borehole.

Figure 2:
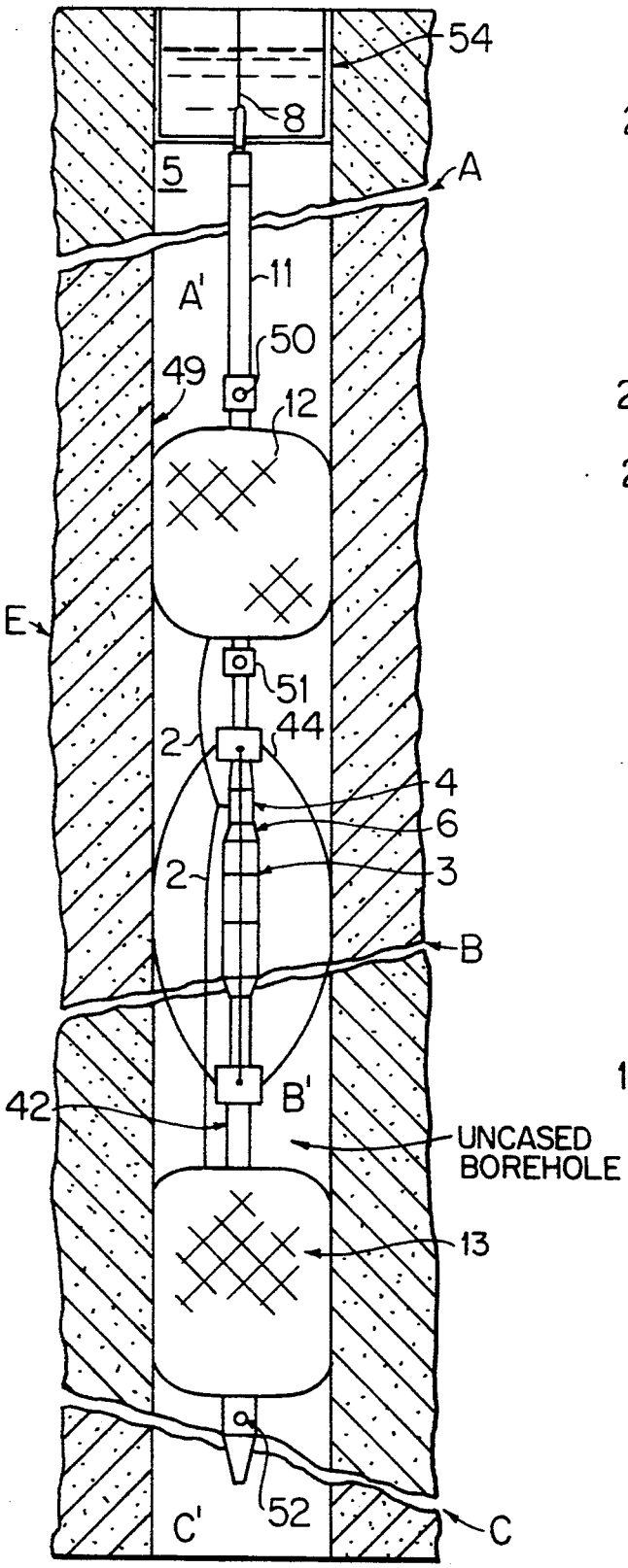
FIG. 2 is a longitudinal view of a borehole packer system similar to that shown in FIG. 1 but having two inflated packers used with fluid pressure transducers.

In another embodiment, shown in FIG. 2, two (or more) packers, indicated at 12 and 13, are connected together, as illustrated, and inflated with a single packer pump 3. The spacing between the packers may be adjusted as desired by adding a spacer 42 and connecting tubing 2 of the required length. With the packer and pressure transducer configuration shown in FIG. 2, the static pressure of the fluid in three hydraulic zones A′, B′, and C′, corresponding to the regions which are in hydraulic communication with the liquid in fractures A, B, and C, respectively, may be separately and simultaneously measured.

Figure 3:
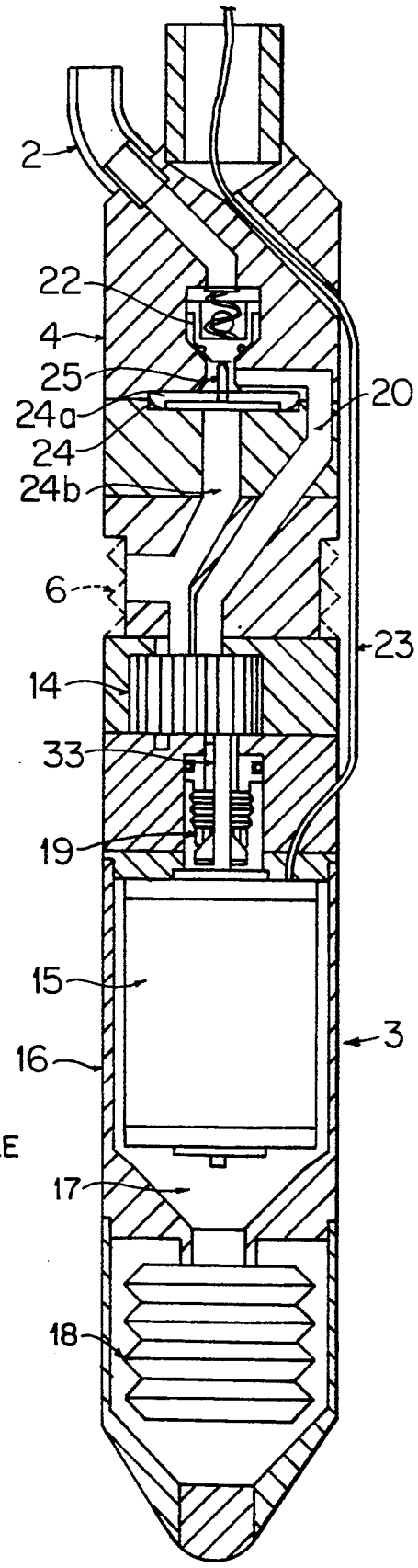
FIG. 3 is a side view of the electric motor powered pump and valve chamber of FIG. 1, used to inflate and deflate the packers.

Referring to FIG. 3, the borehole portion of the pump system 3 of packer 1 is shown. The pump system 3 includes a positive displacement bi-directional pump 14, such as a gear pump, which is driven by a bi-directional electric motor 15 contained within a sealed chamber 16 filled with a suitable liquid 17, e.g., kerosene or light mineral oil. Electrical power is supplied to the electric motor 15 through a water proof electric cable 23 which extends through logging cable 8. The liquid-filled motor chamber 16 is equalized to borehole pressure by a flexible bellows 18 or another type of pressure-equalizing variable-volume reservoir. The pressure-equalizing bellows 18 minimizes the pressure differential across a motor-to-pump shaft seal 19, permitting the use of a simple low-pressure seal, as illustrated on a shaft 33 between the motor 15 and the pump 14. This differential pressure is of concern since the ambient pressure on the pump 14 and packer assembly may be hundreds of bars, while the differential pressures produced by the pump 14 to inflate or deflate the packer 1 may only be a few bars. In addition to pressure equalization, the liquid 17 in motor chamber 16 provides electrical insulation for the electric motor 15 and lubrication for the motor bearings.

Packer 1 is inflated with borehole liquid 5 pumped by the bi-directional pump system 3 (including pump 14) through a passage 20 in the overall housing which is connected to valve chamber 4, then through one-way check-valve 22 in this housing and through tubing 2 to the inflatable packer 1. Check valve 22 keeps packer 1 inflated after the pump system 3 is stopped.

Packer 1 is deflated by reversing the pump system 3 which then creates a reduced pressure within the valve chamber 4 relative to ambient borehole pressure. This reduced pressure causes a diaphragm 24 located in a diaphragm chamber 24*a* in the housing disposed below check-valve 22 to move up, thereby causing an upwardly projecting push rod 25 secured to diaphragm 24 to open check-valve 22, thus allowing the packer 1 to be deflated. Diaphragm chamber 24*a* is connected to passage 20. Diaphragm 24 seals off an intake passage 24*b* from the diaphragm chamber 24*a*. The position of diaphragm 24 within its chamber is determined by the pressure difference between ambient borehole pressure delivered via intake passage 24*b* and that within diaphragm chamber 24*a* delivered from pump 14 via passage 20. When pump 14 is stopped, diaphragm 24 returns to the down position, allowing check valve 22 to close. During inflation, pressure in the diaphragm chamber 24*a* holds diaphragm 24 in the down position where it does not effect the normal operation of check-valve 22.

A packer control panel 7, shown in FIG. 1A, is used to control packer inflation and deflation. The pumping direction of the pump is controlled by a INFLATE/-STOP/DEFLATE switch 45. Pump pressure is a function of the pump motor current which is set by current control 46 and measured by an ammeter 47.

When a reversible direct current electric pump motor 15 is used, INFLATE/STOP/DEFLATE switch 45 determines the polarity of the electric pump motor current, and thus the direction of rotation of the pump 14. Only two electrical conductors are required to power a reversible DC motor, one of which may be the armor of the cable and the attached case of the probe.

When a reversible alternating current pump motor 15 is used, such as a three-phase motor, INFLATE/-STOP/DEFLATE switch 45 determines the relative phase of the electric pump motor current, and thus the direction of rotation of the pump 14. A three-phase motor requires three electrical conductors to power the motor, one of which may be the armor of the cable and the attached case of the probe.

The direction of rotation of the motor 15, and thus of the pump 14, is controlled by the polarity of the electric power supplied for the motor 15 for a DC motor, or by the relative phase of the power supplied for an AC motor.

In operation, packer 1 is inflated by supplying the pump motor 15 with the proper polarity or phase of electric current through the cable 8. Packer inflation pressure is controlled by the amount of current supplied to the motor 15. When the motor power is switched OFF, a check-valve 22 in the valve chamber 4 closes, keeping packer 1 inflated. Packer 1 remains inflated while geophysical measurements such as fluid flow, shut-in formation pressure, etc. are made. Packer 1 is deflated when the packer is to be moved to a different location by running the pump 14 in the reverse direction with reversed polarity or phase of current from the control panel 7 by switching pump control switch 45 to DEFLATE. Reverse pump rotation reduces the pressure in the diaphragm chamber 24*a* to below ambient pressure, causing the opposing diaphragm 24 to move up and open the check-valve 22. This allows pump 14 to withdraw the fluid from packer 1, causing packer 1 to deflate.

Figure 4A:
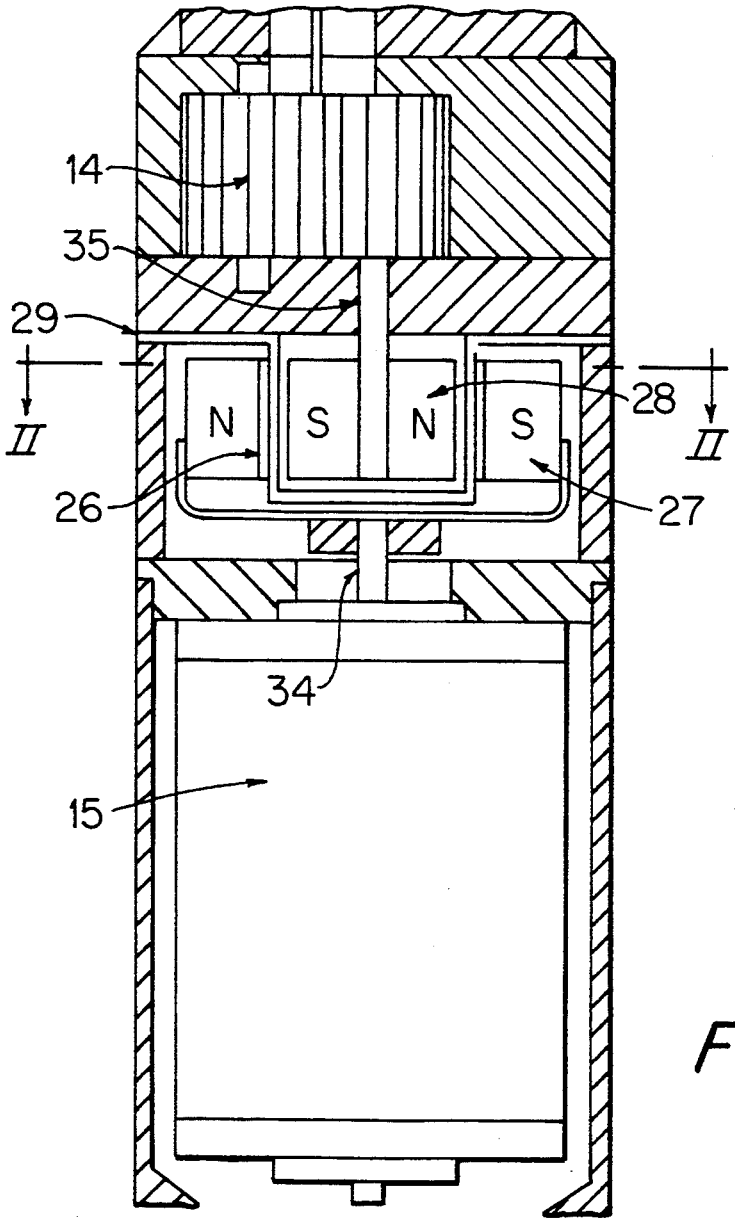
FIG. 4A is a side view of a magnetic coupling used to couple torque from the electric motor to the pump.
Figure 4B:
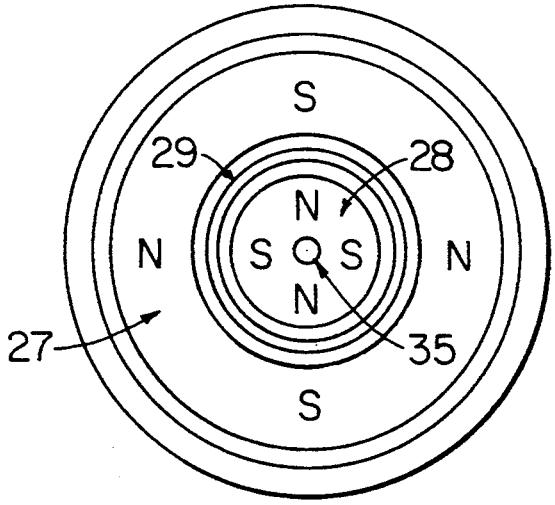
FIG. 4B is a cross sectional view of the magnets of FIG. 4A taken generally along line II—II.

An alternative to attaching the pump directly to the motor shaft 33, which requires a pump shaft seal 19 that is subject to wear and leakage is shown in FIGS. 4A and 4B. Providing magnetic coupling 26 between the motor 15 and pump 14 permits the use of a static seal 29 that is not subject to mechanical wear. One possible configuration for magnetic coupling 26 comprises a concentric pair of toroidal permanent magnets, indicated at 27 and 28, each having one or more pairs of north and south magnetic poles. The driving (motor) magnet 27, is connected to and rotates with the motor shaft 34, while the driven (pump) magnet 28 is connected to and rotates the pump shaft 35. A non-magnetic cup 29 forms a static seal between the motor chamber 16 and the pump 14. Mechanical torque is transmitted from motor shaft 34 to pump shaft 35 via the magnetic force which exists between the poles of concentric magnets 27 and 28 through non-magnetic cup 29.

The details of the wall conforming inflatable packer itself are discussed below in connection with FIGS. 5A–7B. The inflatable packer 1 of one embodiment of the present invention, shown in FIG. 5A, is made in several layers. The inner layer is the bladder 30, made of a impermeable elastic rubber-like material, e.g., an automotive type inner-tube rubber, that can expand to at least several times, e.g., 2.5, its deflated diameter. The expansion of the bladder 30 is constrained to a safe maximum working diameter by a strong flexible fabric reinforcing layer 31 which allows packer inflation to much greater pressures than the bladder 30 could withstand alone. The use of the reinforcing layer 31 prevents the packer 1 from rupturing even if it should be inflated to maximum pump pressure in a large diameter hole in which the packer 1 is not restrained by the walls. The reinforcing layer 31 may be made of nylon, KEVLAR, polyester, or any other high strength material which is unaffected by water, salt or petroleum. The reinforcing layer 31 is covered by a soft, elastic outer layer 32 having the material requirements of bladder 30. The elastic nature of the packer 1 allows it to conform and make a tight seal to a borehole wall 49, even though the wall may be rough and irregularly shaped.

Figure 5B:
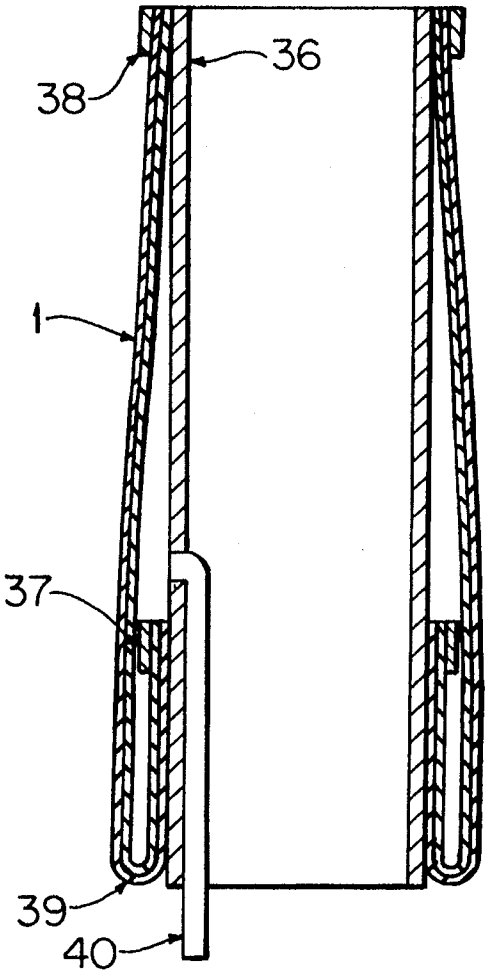
FIGS. 5A and 5B are cross sectional views of the inflated and deflated packer, respectively.
Figure 5A:
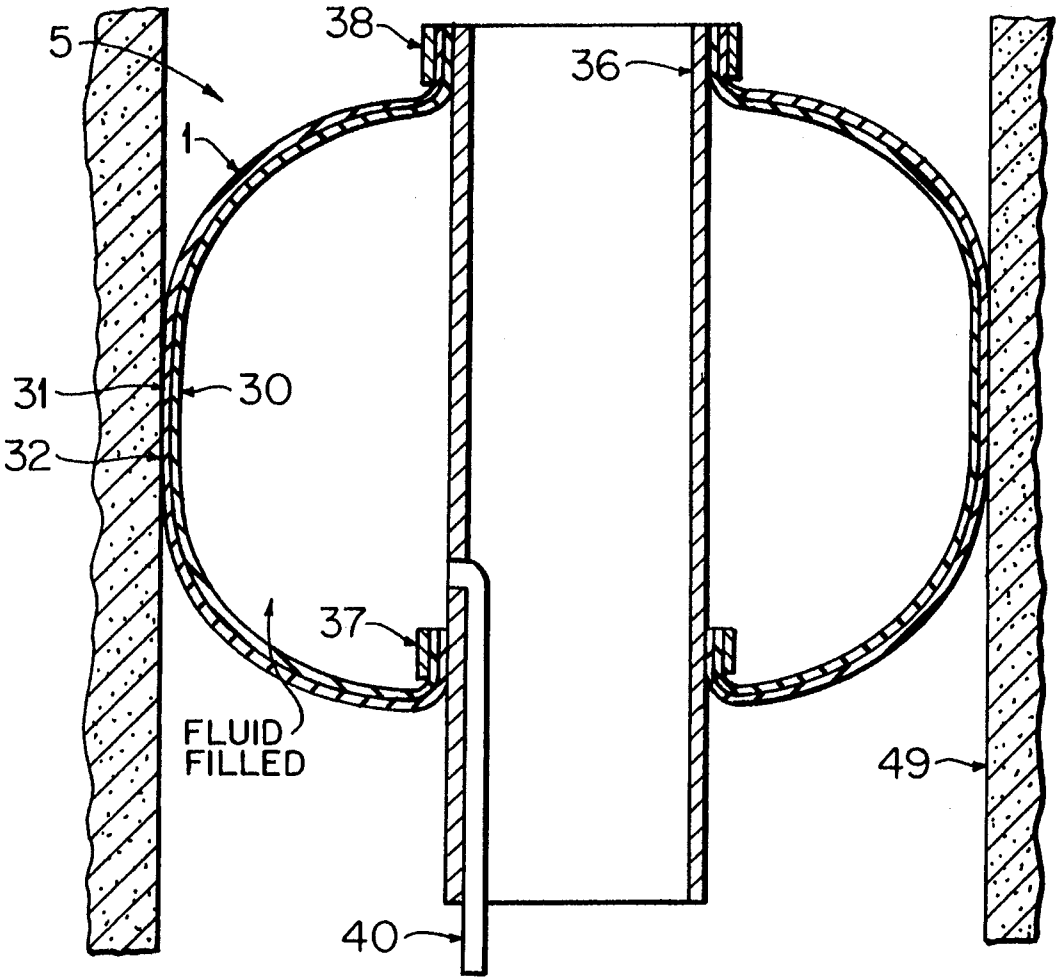

As can be seen in FIGS. 5A and 5B, one end of the cylindrical shaped packer 1 is firmly fastened to a cylindrical supporting mandrel 36 by an inner clamp 37, and the other end of the packer 1 is firmly fastened by an outer clamp 38. As shown in FIG. 5B, during assembly, packer 1 is folded back over itself indicated at 39, below the inner clamp 37, and brought up to the top of the mandrel and clamped by the outer clamp 38. Folding packer 1 back on itself eliminates the need for a sliding packer seal, which would be subject to wear and leakage. The minimum distance between the inner clamp 37 and outer clamp 38 is preferably greater than seventy-five percent of the maximum inflated diameter of the packer 1, shown in FIG. 5A. The unfolded length of the packer tube is advantageously greater than twice the distance between inner clamp 37 and outer clamp 38. The supporting mandrel 36 is preferably long enough so that the folded end 39 of the deflated packer, as shown in FIG. 5B, will not extend beyond mandrel 36. Borehole liquid 5 is pumped into and out of the packer 1 through the rigid packer fill tube 40 which extends from within the packer chamber to beyond the end of the packer mandrel 36.

Figure 6A:
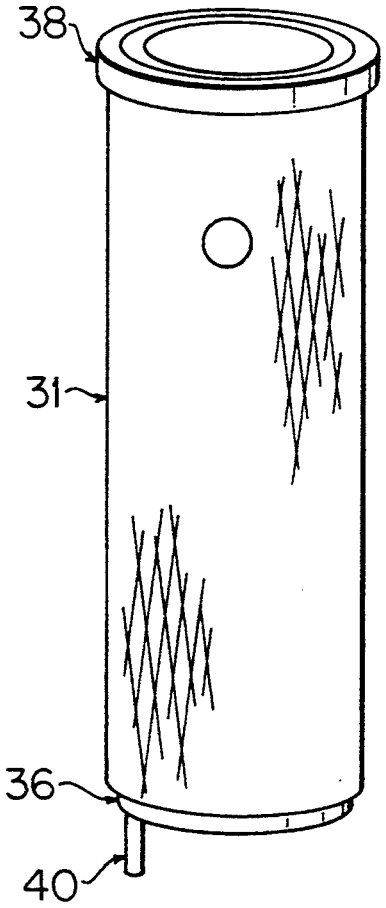
FIGS. 6A and 6C are perspective views of the bladder reinforcing fabric configuration in the deflated and inflated conditions, respectively.
Figure 6C:
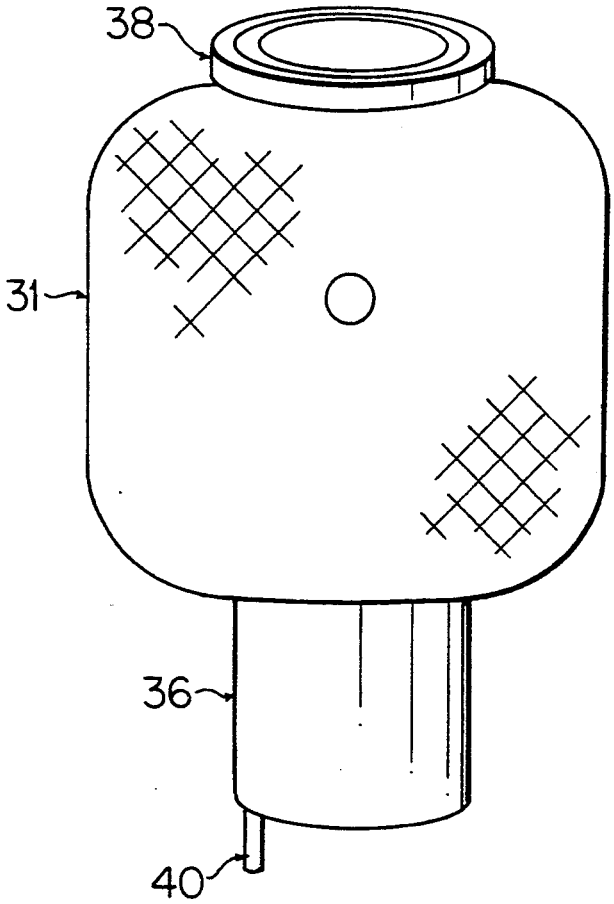
Figure 6B:
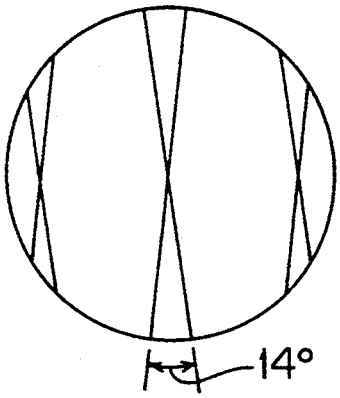
FIGS. 6B and 6D are enlarged views of the encircled portion in FIGS. 6A and 6C, respectively.
Figure 6D:
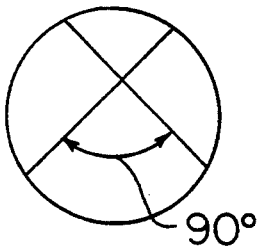

The cylindrical reinforcing layer 31 of the deflated packer is shown in detail in FIG. 6A, in which figure the packer is shown without the outer elastic covering. To allow the reinforcing layer 31 to expand to large diameters, the individual reinforcing fibers are positioned at a small angle, such as, for example, plus or minus seven degrees, relative to the axis of the minimum cylindrical shape of the deflated packer. The crossing angle of the two counterwound sets of fibers will be twice this angle, or about fourteen degrees, shown in detail in FIG. 6B. When the packer is inflated, as shown in FIG. 6C, the reinforcing layer 31 will expand in diameter and decrease in length until the crossing angle of the two sets of fibers reaches approximately ninety degrees. At a fiber crossing angle of about ninety degrees, shown in detail in FIG. 6D, the axial forces on the reinforcing fabric 31 will be equal to the perpendicular tangential forces, and diametric expansion will cease even through inflation pressure may continue to increase. If the inflated packer were in the form of a sphere, the angle between crossing strands at maximum inflation would be exactly ninety degrees. Since the reinforcing fabric 31 is essentially non-elastic, the length of the reinforcing fabric cylinder will decrease as its diameter increases, as shown by the increased exposure of the mandrel 36 between FIGS. 6A and 6B. In the finished packer 1, the outer elastic covering 32 aids in returning the deflated packer to its original minimum diameter. The three layers may be vulcanized into a single layer.

Figure 7A:
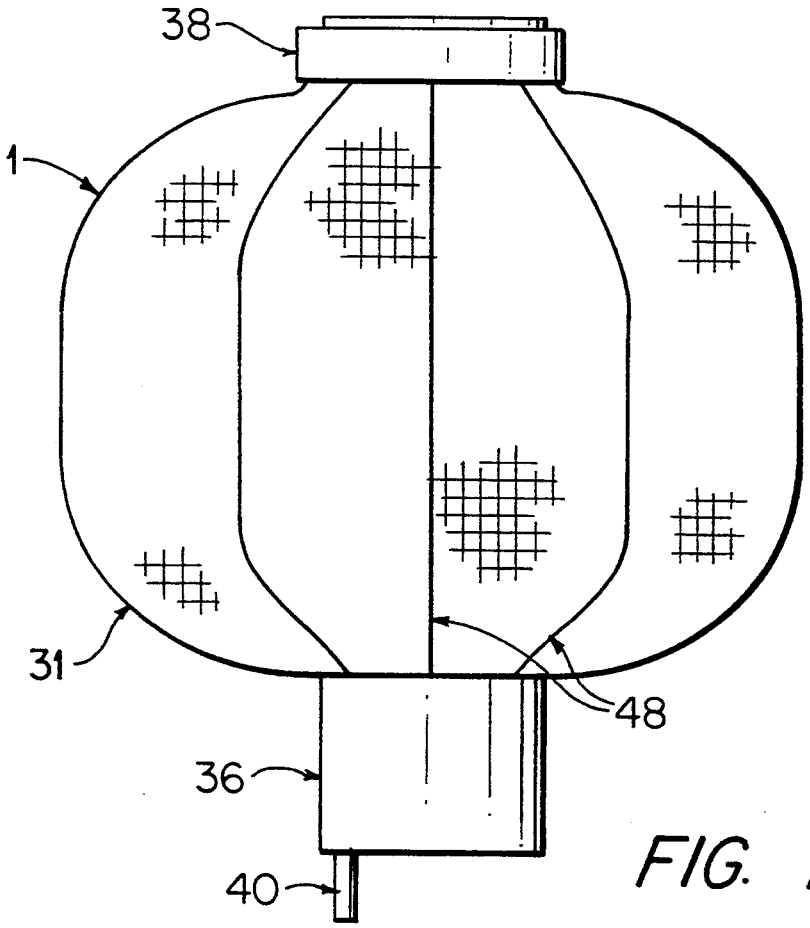
FIGS. 7A and 7B are side and end views, respectively, of an alternate design for the reinforcing fabric having a cylindrical shape with hemi-spherical ends when in the inflated condition.
Figure 7B:
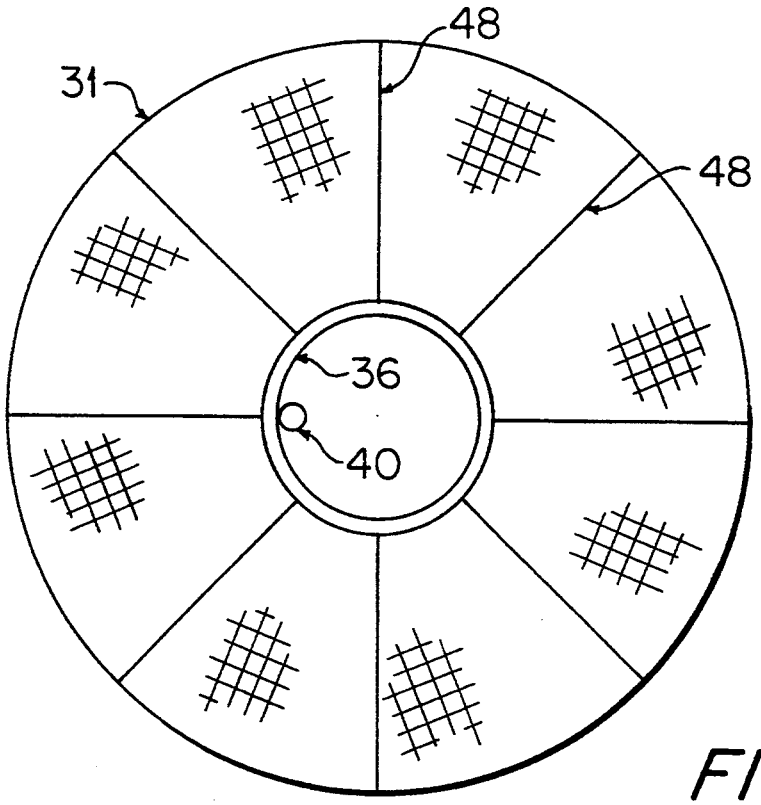

In an alternate design, shown in FIGS. 7A and 7B, the packer reinforcing layer 31 is made from conventionally woven fabric whose warp and woof fibers cross at ninety degrees. A rectangular sheet of reinforcing material is first sewn into the shape of a cylinder whose diameter equals the maximum working diameter of the packer. Tucks 48 are sewn into the ends of the cylinder so that the finished shape of the ends of the fully inflated packer is approximately that of a hemisphere. A packer 1 using this design of reinforcing layer 31 depends entirely upon the outer elastic covering 32 to return the deflated packer to its original minimum diameter when it is deflated.

Wireline powered straddle packers may be used with pressure transducers or other geophysical instruments to permit rapid measurements at different depths and with various packer and transducer spacings. While a vertical borehole application is shown for the purpose of illustration, the packer system may be used in any orientation (e.g., vertical, horizontal or diagonal) and for any situation requiring an inflatable packer where the resident liquid may be used to inflate the packer.

If the liquid in the borehole is not suitable for use in inflating the packers, a captive liquid may be used by providing a collapsible bladder type reservoir connected to the input of the pump and containing a suitable liquid such as clean water. This collapsible reservoir would serve to provide pressure equalization between the reservoir liquid and the resident well liquid.

Although the present invention has been described above relative to exemplary preferred embodiments thereof, it will be understood by those skilled in the art that variations and modifications can be effected in these embodiments without departing from the scope and spirit of the invention as defined in the claims which follow.

What is claimed is:

1. An inflatable borehole packer system comprising:

a wall conforming inflatable packer;

means for pumping liquid at ambient pressure into and out of said inflatable packer for inflating and deflating said inflatable packer in its entirety; and an inflation/deflation valve chamber, disposed between said pumping means and said inflatable packer for controlling fluid flow into and out of said inflatable packer, said valve chamber including valve means for preventing fluid from flowing out of said inflatable packer when said pumping means is stopped, and a differential pressure sensitive valve release means for opening said valve means when said pumping means reduces pressure in the valve chamber to below said ambient pressure, allowing said pumping means to withdraw liquid from the inflated packer, thus deflating the packer.

2. The packer system as recited in claim 1, wherein said liquid at ambient pressure comprises resident borehole liquid.

3. The packer system as recited in claim 1, wherein said pumping means includes a bi-directional pump.

4. The packer system as recited in claim 3, wherein said pumping means further includes a bi-directional electric motor supplying power to said bi-directional pump, said electric motor receiving power from a surface module through electric conductors of a logging cable.

5. The packer system as recited in claim 4, wherein said pumping means further includes magnetic means for coupling said bi-directional electric motor to said bi-directional pump.

6. The packer system as recited in claim 4, wherein said pumping means includes a liquid filled housing that is pressure equalized to said ambient pressure and said electric motor is contained in said housing.

7. The packer system as recited in claim 6, wherein said liquid filling said housing is electrically non-conductive, is non-corrosive, has low viscosity and provides lubrication to said electric motor.

8. The packer system as recited in claim 1, wherein said valve means includes a one-way valve.

9. The packer system as recited in claim 8, wherein said differential pressure sensitive valve release means comprises a negative differential pressure actuated diaphragm which opens said one-way valve when said inflatable packer is to be deflated.

10. The packer system as recited in claim 1, wherein said system comprises a plurality of packers arranged to be positioned at varying depths within a borehole, said plurality of packers being inflated and deflated by at least one reversible pump.

11. The packer system as recited in claim 1, wherein said inflatable packer comprises:

a bladder comprising an elastic material; and flexible reinforcing fabric covering said bladder.

12. The packer system as recited in claim 11, wherein said flexible reinforcing fabric comprises fibers crossing at approximately ninety degrees when said inflatable packer is fully inflated.

13. The packer system as recited in claim 11, wherein said inflatable packer further comprises an outer elastic covering surrounding said flexible reinforcing fabric.

14. The packer system as recited in claim 1, wherein said inflatable packer has a top and a bottom and said top and bottom of said inflatable packer are clamped in a fixed position onto a central mandrel, said bottom being folded back under itself towards said central mandrel.

15. The packer system as recited in claim 14, wherein said central mandrel comprises a hollow mandrel and said packer system further comprises a geophysical instrument located within said mandrel.

16. The packer system as recited in claim 14, wherein said central mandrel comprises a solid mandrel and said packer system further comprises a geophysical instrument affixed to said mandrel.

17. The packer system as recited in claim 1 further comprising:

a power and control module remotely located from said inflatable packer; and an electric and mechanical support cable connecting said module to said pumping means.

18. The packer system as recited in claim 17, wherein said pumping means further includes a motor, liquid pressure in said inflatable packer being controlled by an amount of current supplied to said motor by said power and control module.

19. The packer system as recited in claim 17, said electric and mechanical support cable exceeds 5000 meters in length.

20. The packer system as recited in claim 1, wherein said ambient pressure exceeds 500 bars.

* * * * *